US006419593B1

(12) United States Patent
Heinrich et al.

(10) Patent No.: US 6,419,593 B1
(45) Date of Patent: Jul. 16, 2002

(54) GOLF CLUB HAVING A THERMIC-SPRAY COATING

(75) Inventors: Peter Heinrich, Germering; Heinrich Kreye, Hamburg, both of (DE)

(73) Assignee: Linde Technische Gase GmbH, Hoellriegelskreuth (DE)

( * ) Notice: Subject to any disclaimer, the term of this patent is extended or adjusted under 35 U.S.C. 154(b) by 41 days.

(21) Appl. No.: 09/217,820

(22) Filed: Dec. 22, 1998

(30) Foreign Application Priority Data

Dec. 23, 1997 (DE) ..... 197 57 736

(51) Int. Cl.[7] ..... A63B 53/04

(52) U.S. Cl. ..... 473/324; 473/330; 473/349; 473/409

(58) Field of Search ..... 473/324–350

(56) References Cited

U.S. PATENT DOCUMENTS

| | | | |
|---|---|---|---|
| 2,908,502 A | * | 10/1959 | Bradstreet |
| 4,519,612 A | | 5/1985 | Tsao |
| 4,768,787 A | * | 9/1988 | Shira |
| 5,272,802 A | | 12/1993 | Stites, III |
| 5,302,414 A | | 4/1994 | Alkhimov et al. |
| 5,531,444 A | | 7/1996 | Buettner |

FOREIGN PATENT DOCUMENTS

| | | |
|---|---|---|
| DE | 196 10 054 | 9/1997 |
| EP | 0 484 533 | 5/1992 |
| EP | 0 925 810 | 6/1999 |
| JP | 60-083677 | 5/1985 |
| JP | 05-084335 | 4/1993 |
| JP | 10-230028 | 9/1998 |
| JP | 11-4920 | 1/1999 |
| WO | WO 97/20961 | 6/1997 |

OTHER PUBLICATIONS

Patent Abstracts of Japan, Publication No. 07059881 A, Mar. 7, 1995.
Patent Abstracts of Japan, Publication No. 09168614 A, Jun. 30, 1997.

* cited by examiner

*Primary Examiner*—Sebastiano Passaniti
(74) *Attorney, Agent, or Firm*—Crowell & Moring LLP

(57) ABSTRACT

The invention relates to a golf club with a striking surface for striking golf balls. The golf club has a coating applied by a thermal spray method at least in the area of the striking surface. The club coatings are preferably applied by a high-speed flame spray method or by a cold gas spray method. For coating golf clubs by hot spraying, in particular metals, metal alloys, oxides, (especially $Al_2O_3$ and/or $TiO_2$), carbides, borides, plastics, or mixtures of the above substances can be used as the spray materials.

16 Claims, No Drawings

GOLF CLUB HAVING A THERMIC-SPRAY COATING

BACKGROUND AND SUMMARY OF THE INVENTION

This application claims the priority of German Application No. 197 57 736.9, filed Dec. 23, 1997, the disclosure of which is expressly incorporated by reference herein.

The invention relates to a golf club with a striking surface for striking golf balls.

When playing golf it is important to be able to hit the golf ball out of a wide variety of situations taking into account the range, the ground, and any obstacles. The golf ball should be hit with as much control as possible in the direction of the hole. In order to meet these various requirements, different types of golf clubs are usually employed. The player usually selects the club that he feels is suitable for the next blow (shot). As a rule, at least in the area of the club head that contains the striking surface, the individual clubs differ in club material, the angle of the striking surface, and the surface quality in the area of the striking surface.

The goal of the present invention is to improve golf clubs in terms of their striking properties and to design them, especially in the area of their striking surfaces, such that the possibilities, abilities, and suitabilities for certain applications are increased. First of all, clubs should be provided which also allow especially long blows, or to even make them possible at all. On the other hand, however, clubs for sensitive soft blows over short distances must also be provided. Finally, golf clubs should also be provided which allow for blows which generate spin on the ball.

This goal is achieved according to the invention by virtue of the fact that the golf club has a coating applied by a thermal (hot) spray method, at least in the area of the striking surface.

The advantage of the invention consists in the fact that by coating the golf club using a thermal spray process (hot spray process), a wide range of golf clubs with a wide variety of properties is made possible. This permits optimum adaptation of the properties, especially the surface properties, of the striking surface in addition to the possibilities that are offered in any case by the choice of the material of the club and especially of the club head. Thermal spray methods offer possibilities for manufacturing club coatings from a wide variety of materials, with the thermal spray method making possible coating compositions that other manufacturing methods for coatings do not allow.

DETAILED DESCRIPTION OF THE INVENTION

Thermal spray methods are essentially characterized by the fact that they provide uniformly applied coatings of high quality and goodness. Coatings applied by the thermal spray method can be adapted to various requirements by varying the spray materials and/or the method parameters. The spray materials can be processed in the form of wires or rods or as powder. Aftertreatment can also be provided.

Thermal spray coating includes, as variations on the method, basically autogenic flame spraying or high-speed flame spraying, arc spraying, plasma spraying, detonating spraying, laser spraying, and the like.

Thermal spray methods are described in general for example in Übersicht und Einführung in das "Thermische Spritzen" (Overview and Introduction to "Thermal Spraying" ) by Peter Heinrich, Linde-Berichte aus Technik and Wissenschaft, 52/1982, pages 29 to 37, or Thermisches Spritzen—Fakten und Stand der Technik (Thermal Spraying—Facts and State of the Art), by Peter Heinrich, Jahrbuch Oberflächentechnik, 1992, Vol. 48, 1991, pages 204 to 327, Metall-Verlag GmbH.

Recently, another thermal spraying method has been developed which is also referred to as cold gas spraying. It is a form of an improvement on high-speed flame spraying. This method is described for example in European Patent EP 0 484 533 B1. In cold gas spraying, an additional material in powder form is used. The powder particles, however, in cold gas spraying are not melted in the gas stream. Instead, the temperature of the gas stream is below the melting point of the powder particles of the additional material (EP 0 484 533 B1). In the cold gas spraying method, therefore, a gas that is "cold" by comparison with conventional thermal spraying methods or a comparatively colder gas is used. Nevertheless, however, the gas is heated as in the conventional method, but as a rule only to temperatures below the melting point of the powder particles of the added material.

Depending on the thermal spray method used, a certain coating of the golf club with certain properties results. The best results can be achieved if the coating is applied by the high-speed flame spray method or by the cold gas spray method. As the high-speed flame spray method, high-speed flame spraying of the first generation with sprayed particle speeds up to 350 m/s, high-speed flame spraying of the second generation with sprayed particle speeds between 350 and 650 m/s, and preferably high-speed flame spraying of the third generation with sprayed particle speeds above 650 m/s are used. In cold gas spraying, the powder particles can be accelerated to speeds of 300 to 1600 m/s. In particular, speeds of the powder particles between 1000 and 1600 m/s are suitable, especially preferably between 1250 and 1600 m/s, since in this case the energy transfer in the form of kinetic energy is especially high.

For coating golf clubs using thermal spraying, spray materials that can be used include in particular metals, metal alloys, oxides (especially $Al_2O_3$ and/or $TiO_2$), carbides, borides, plastics, or mixtures of the above substances.

To manufacture golf clubs by means of the thermal spraying method, a powder is preferably employed. In particular, powders with particle sizes of one $\mu$m to 1 mm, especially preferably 5 to 100 $\mu$m, are suitable.

As gases for thermal spraying, nitrogen, helium, argon, neon, krypton, xenon, a gas containing hydrogen, a gas containing carbon, especially carbon dioxide, oxygen, a gas containing oxygen, air or mixtures of the above gases are used for example. In addition to the gases known from EP 0 484 533 B1, air and/or helium, a nitrogen, argon, neon, krypton, xenon, oxygen, a hydrogen containing gas, a carbon containing gas, especially carbon dioxide, or mixtures of the above gases and mixtures of these gases with helium are also suitable for the gas that carries the powdered additional material. The amount of helium in the total gas can be as high as 90 volume per cent. Preferably a helium component of 10 to 50 volume percent is contained in the gas mixture.

It has been found that by using these various gases and gas mixtures for accelerating and carrying a powdered additional material or sprayed material, the flexibility and efficacy of the thermal spray method can be increased significantly during the coating of golf clubs. The layers thus produced adhere very well to a wide variety of substrate materials, for example to metals or metal alloys of golf clubs and especially of the club head in the area of the striking surface. The coatings are all of high quality, exhibit extraordinarily low porosity, and have sprayed surfaces such that as a rule there is no need for finishing. The gases mentioned have a sufficient density and sonic speed in order to be able to ensure the required high speeds of the powder particles, especially in cold gas spraying. The gas can contain inert and/or reactive gases.

The invention allows for making golf clubs with striking surfaces having comparatively high spring energy. These are preferably used for long drives (distances). It has been found that these golf clubs according to the invention allow extremely long drives which are not uncontrolled despite the greater range.

By means of thermal spray methods, especially by means of the high-speed flame spray method or by the cold gas spray method, a soft coating can also be applied. Golf clubs thus designed are intended primarily for sensitive shots over shorter distances, and especially for putting.

As a result of thermal sprayed coatings on golf clubs, the coefficient of adhesive friction can be increased relative to conventional golf clubs. This is because a high coefficient of adhesive friction of the coating in the area of the striking surface relative to the golf ball can be achieved. With such golf clubs, a stroke with a spin (for example hook, slice, backspin) can be performed without difficulty.

The thermal sprayed coating can serve for the golf club as protection against slip and/or wear possibly in addition to other properties.

In practical tests, for example, golf clubs with thermal sprayed coatings in the area of the striking surface have demonstrated outstanding performance, whose spray coatings contained WCCo.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A golf club for striking a golf ball, comprising:

a striking surface adapted to strike the golf ball; and a thermal cold spray coating applied to the striking surface at least in a portion of the area thereof.

2. The golf club according to claim 1, wherein the thermal spray coating comprises one of metals, metal alloys, oxides, carbides, borides, plastics, and mixtures of the above substances.

3. The golf club according to claim 1, wherein the thermal spray coating is a metal coating formed of hard substances.

4. The golf club according to claim 3, wherein the hard substances are carbides.

5. The golf club according to claim 1, wherein the thermal spray coating has a comparatively high spring energy.

6. The golf club according to claim 1, wherein the thermal spray coating is a soft coating.

7. The golf club according to claim 1, wherein the thermal spray coating increases a coefficient of adhesive friction of the striking surface.

8. The golf club according to claim 1, wherein the thermal spray coating functions to protect the striking surface against at least one of slip and wear.

9. The golf club according to claim 1, wherein said thermal cold gas spray coating is applied by accelerating powder particles to a particle speed above 1000 m/s.

10. The golf club according to claim 9, wherein the powder particles have particle sizes ranging from between 1 $\mu$m to 1 mm.

11. A method of making a golf club, the method comprising the acts of:

applying a coating at least to a portion of a striking surface of the golf club;

wherein the act of applying the coating is performed by a thermal spray method which is a cold spray method.

12. The method according to claim 11, wherein the act of applying the coating is performed by accelerating powder particles to a particle speed of above 1000 m/s.

13. The method according to claim 12, wherein the powder particles have particle sizes ranging from between 1 $\mu$m to 1 mm.

14. A coating method for a golf club, the method comprising the act of thermally spraying a coating on the golf club at least in an area of a striking surface of the golf club, wherein the act of thermally spraying the golf club comprises the act of cold spraying the coating on the golf club.

15. The coating method according to claim 14, wherein the act of applying a cold spray coating to the golf club is carried out by accelerating powder particles to a particle speed of above 1000 m/s.

16. The coating method according to claim 15, wherein the powder particles have particle sizes ranging from between 1 $\mu$m to 1 mm.

* * * * *